US005893781A

United States Patent [19]

Matsunaga et al.

[11] Patent Number: 5,893,781

[45] Date of Patent: Apr. 13, 1999

[54] BATTERY TERMINAL WITH CORE WIRE END COVER

[75] Inventors: Hideki Matsunaga; Kenji Inoue, both of Yokkaichi, Japan

[73] Assignee: Sumitomo Wiring Systems, Ltd., Japan

[21] Appl. No.: 08/843,386

[22] Filed: Apr. 15, 1997

[30] Foreign Application Priority Data

May 14, 1996 [JP] Japan ..... 8-119207

[51] Int. Cl.[6] ..... H01R 4/42

[52] U.S. Cl. ..... 439/762; 439/948

[58] Field of Search ..... 439/388, 754, 439/755, 761, 762, 763, 764, 766, 881, 882, 868, 867, 877, 879, 948

[56] References Cited

U.S. PATENT DOCUMENTS

| | | | |
|---|---|---|---|
| 1,255,037 | 1/1918 | Oestricher | 439/868 |
| 2,760,179 | 8/1956 | Schaefer | 439/869 |
| 3,455,022 | 7/1969 | Schmitz, Jr. | 439/877 |
| 3,867,007 | 2/1975 | Wening | 439/726 |
| 4,063,794 | 12/1977 | Dittmann | 439/763 |
| 4,221,446 | 9/1980 | Niles et al. | 439/879 |
| 4,795,380 | 1/1989 | Frantz | 439/860 |
| 5,290,646 | 3/1994 | Asao et al. | 429/178 |
| 5,346,408 | 9/1994 | Chupak | 439/744 |
| 5,389,466 | 2/1995 | Inoue et al. | 439/761 |
| 5,498,178 | 3/1996 | Tabata | 439/762 |
| 5,516,311 | 5/1996 | Maejima | 439/877 |
| 5,567,187 | 10/1996 | Bellinger | 439/877 |
| 5,588,883 | 12/1996 | Hattori | 439/761 |

FOREIGN PATENT DOCUMENTS

| | | | |
|---|---|---|---|
| 2620579 | 3/1989 | France | 439/882 |

*Primary Examiner*—Neil Abrams
*Attorney, Agent, or Firm*—Banner & Witcoff, Ltd.

[57] ABSTRACT

A fastening member 30 of a battery terminal 10 has a core wire covering member 32 formed by bending a pair of protecting members 32*a* which extend from the root portion of a wire barrel 31. The core wire covering member 32 is between the connecting portion 20 and the usual wire barrel portion 31, and is approximately rectangular when seen in cross-section. A clamp bolt 50 and nut 51 are tightened by means of a spanner or the like, thereby attaching the battery terminal 10 to a battery post P. The covering member 32 ensures that the end of the core wire or loose strands of the core wire do not interfere with the tightening operation or become caught on the operator's hand or on a tool. The wire covering members 33, 34 may include inspection apertures 33*c*, 34*b*.

10 Claims, 4 Drawing Sheets

BATTERY TERMINAL WITH CORE WIRE END COVER

TECHNICAL FIELD

The present invention relates to a battery terminal and particularly a terminal that ensures protection of the core of an insulated electric wire.

BACKGROUND TO THE INVENTION

An example of a conventional battery terminal is shown in FIG. 10 and FIG. 11. This terminal 1 has long and short fastening members 2,3 formed by bending a metal strip into a hair-pin shape so that the fastening members 2 and 3 face each other. The bent portion is formed into a circular connecting member 4 to accommodate a battery post P. The connecting member 4 is fixed to the battery post P by passing a bolt 5 through the fastening members 2 and 3 and fastening the bolt 5 by means of a nut 6. Further, the anterior end of one of the fastening members 2 is provided with a wire barrel 2*a* into which a core wire S of an electric wire W is crimped, as illustrated.

In the conventional battery terminal 1 described above, the end of the core wire S needs to extend slightly from the wire barrel 2*a* in order to effect its connection with the battery terminal 1 with certainty. This extreme end interferes with an operator's hand movements when the nut 6 is rotated by means of a spanner or the like during the attachment or removal operation. Moreover, when the wire core S strikes against the spanner or the like, the constituent wires splay out, and thus increases the likelihood of interference, and potential injury to the hand of an operator.

The present invention has been developed after taking the above problems into account, and aims at providing a battery terminal having superior manageability by precluding interference with the operator's hands, a spanner or the like.

SUMMARY OF THE INVENTION

According to the invention, there is provided a terminal for attachment to a battery post P, and comprising a connecting member for encircling said post and a wire barrel portion adapted to receive and crimp the core of an electrical wire, the terminal further including a covering member for the end of a core wire, the covering member being disposed between the connecting member and the wire barrel portion.

Such a covering member permits the wire core to protrude from the wire barrel portion, thus ensuring a full crimping length of the core, yet protects the end of the core from contact with the operator or a tool. The terminal may consequently be removed from and attached to a battery post repeatedly without contact damage or the risk of injury to the operator.

Preferably an abutment is provided to limit insertion through the wire barrel portion; the abutment may be pressed or sheared out of the terminal and provides a positive insertion stop for the wire core. This arrangement facilitates rapid assembly of the terminal on the electrical wire, and ensures that insulation can be removed from the wire by an amount precisely equivalent to the crimping length of the terminal. In turn this ensures that uninsulated core wire does not protrude from barrel portion on the wire side thereof.

The covering member may be formed integrally with the terminal, or may be a separate component attachable to the usual clamp fastener by way of an aperture therein.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

A first embodiment of the present invention is explained hereinbelow, with reference to FIGS. 1 to 3.

Figure 1:
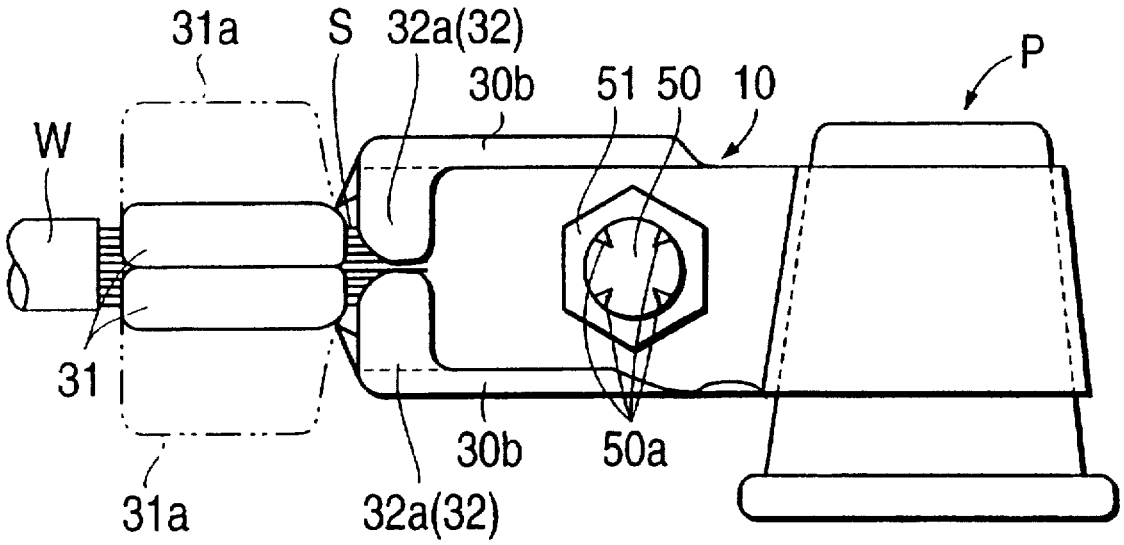
FIG. 1 is a side view of a battery terminal relating to the first embodiment of the present invention.

FIG. 1 shows a battery terminal 10 connected to a battery post P.

The battery post P is cylindrical with the upper end tapering off. The battery terminal 10 is formed from an electrically conducting metal strip so as to form a hair pin shape. More specifically, its bent portion consists of a connecting member 20 that fits with the exterior of the battery post P, and, as shown in FIG. 2, long and short fastening members 30 and 40 are provided at both ends of the connecting members 20 so as to extend in a parallel manner.

These fastening members 30 and 40 have respective through holes formed therein. A bolt 50 is passed through the shorter fastening member 40 into the longer fastening member 30, the bolt 50 being tightened by means of a nut 51. When the bolt 50 and the nut 51 are tightened, the inner diameter of the connecting member 20 decreases, thereby causing its inner periphery to be fixed firmly with the outer circumferential face of the battery post P. When the bolt 50 and the nut 51 are loosened, due to its resilience the diameter of the connecting member increases, thereby allowing the battery terminal 10 to be separated from the battery post P.

Figure 2:
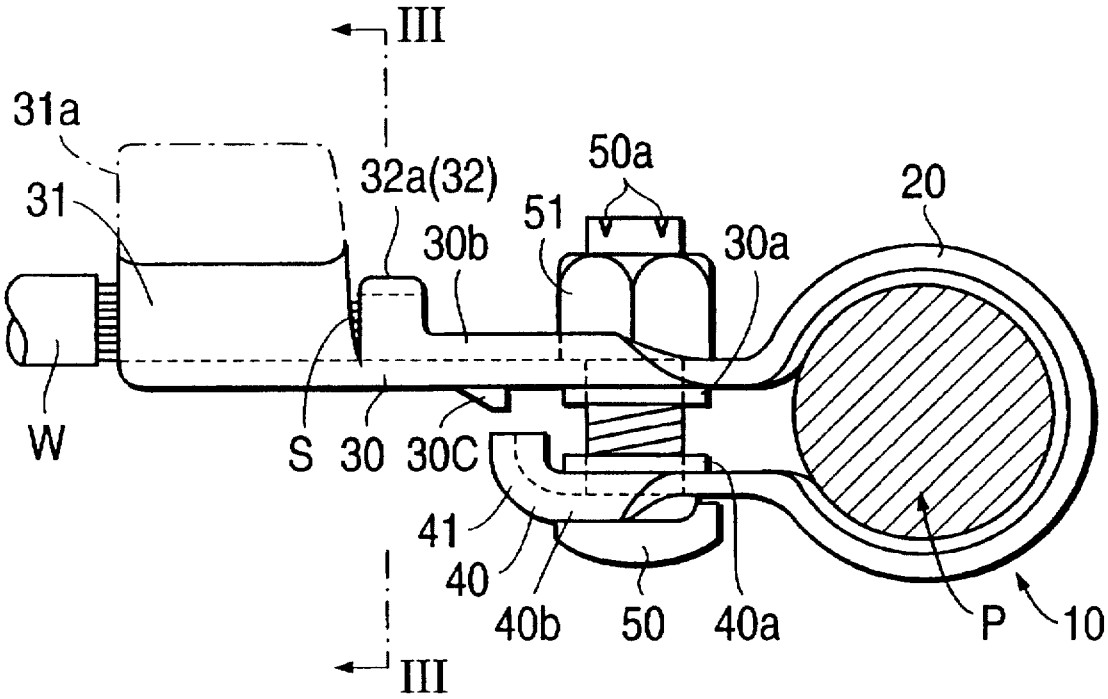
FIG. 2 is a plan view of the battery terminal of FIG. 1.

Moreover, as shown for example in FIGS. 1 and 2, the anterior end of the bolt 50 has a plurality of radially extending rotation preventing cuts 50*a* formed by deforming the thread of the screw, these cuts 50*a* being formed after the nut 51 has been screwed on to the anterior end of the bolt 50. This is done in order to prevent the nut 51 from being lost. Accordingly, even if the nut 51 is loosened, it does not separate from the bolt 50, thereby preventing the bolt 50 from falling out of the battery terminal 10. Moreover, the edges of the open ends of the through holes of the fastening members 30 and 40 have short tubular projections 30*a* and 40*a* extending towards the respectively facing fastening members 30 and 40, and which serve to guide the bolt 50.

The shorter fastening member 40 has an L shaped bent member 41 formed by bending the anterior end of the fastening member 40 in the direction of the fastening member 30. As the bolt 50 and the nut 51 are tightened, the bent member 41 makes contact with the corresponding fastening member 30, thereby preventing excessive tightening.

Moreover, the sides of the fastening members 30 and 40 that are located opposite to the sides facing each other have strengthening walls 30b and 40b provided by bending up the edges into an L shape. The pair of ribs 40b formed on the bent member 41 engage a protruding member 30c of the fastening member 30 that is positioned so as to be located between these ribs 40b. When the fastening members 30 and 40 are brought together, the protruding member 30c enters between the ribs 40b of the bent member 41, thereby preventing the fastening members 30 and 40 from slipping from their positions.

Figure 3:
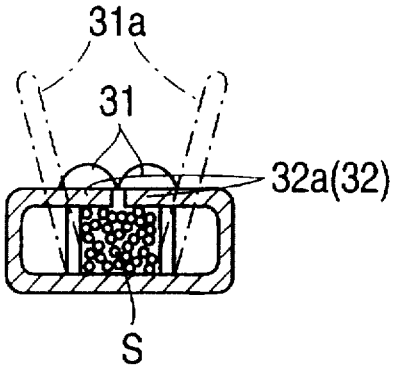
FIG. 3 is a cross-sectional view of FIG. 2 along III—III.

As shown by broken lines in FIGS. 1 and 3, before the clamping of the wire W is carried out, the anterior end of the longer fastening member 30 has a pair of clamping members 31a protruding up from the fastening member 30 in a U shape. The core wire S of the electric wire W is inserted between these clamping members 31a and both the clamping members 31a are crimped down. This results in the formation of a tubular wire barrel 31, as shown by unbroken lines in FIGS. 1 and FIG. 3. As a result, the anterior end of the core wire S is fixed to the battery terminal 10. Making the wire core S protrude from the wire barrel 31 is necessary in order to visually ascertain whether the wire core S is fully within the wire barrel 31.

Towards the anterior end of the electric wire W (the right side in FIG. 1), the wire barrel 31 has core wire covering members 32 formed so as to cover the core wire'S protruding from the wire barrel 31. These core wire covering members 32 have a pair of protecting arms 32a that protrude from the sides of the battery terminal 10 in the same direction as the clamping members 31a, the protecting members 32a being bent so as to form an approximately C shape, thereby resulting in an angular tubular recess, as shown in FIG. 3. The wire core S is located inside the protecting members 32a.

In use, the insulating covering of the electric wire W is shaved off and the core wire S is inserted between the pair of clamping members 31a, which form a U shaped groove. The anterior end of the core wire S is made to protrude slightly from the clamping members 31a, and this anterior end is positioned in the core wire covering member 32. When the clamping members 31a are clamped together in this state, the core wire S is fixed completely in the battery terminal 10 and its anterior end protrudes from the anterior end of the wire barrel 31. However because the core wire S is located within the core wire covering member 32a, the wire is protected from the exterior.

In order to attach the battery terminal 10 to the battery post P, first the bolt 50 and the nut 51 are loosened and the connecting member 20 widened to make it easier for the battery post P to be inserted onto the battery terminal 10. At this juncture, since the anteriorly located portion of the thread of the bolt 50 is deformed, there is no possibility of the nut being lost.

The connecting member 20 is fitted to the battery post P from the anterior end thereof, and the nut 51 is tightened using, for example, a spanner or the like, causing the diameter of the connecting member 20 to decrease. Accordingly, the battery terminal 10 is attached to the battery post. Furthermore, when the battery terminal 10 is to be separated from the battery post P, the nut 51 is loosened, thereby widening the connecting member 20.

When the attachment or removal operation of such a battery post P is to be carried out, since the core wire covering member 32 is protecting the core wire S, there is no possibility of the operation efficiency deteriorating due to the core wire S getting entangled with, for example, the hands of the operator or a tool. Furthermore, in order to protect the core wire, although one possibility is, for example, to wrap vinyl tape on to the anterior end of the core wire S, if a tool or the like strikes against it and tears it, the core wire S is exposed, bringing about the possibility of the operator's hands getting caught. However, in the case of the battery terminal 10 of the present embodiment, even if the spanner or the like, used during the attachment or removal operations, is used roughly, the anterior end of the core wire S protruding from the wire barrel 31 remains protected from its periphery by means of the core wire covering member 32 in which it is located. Accordingly, there is no possibility of the tool colliding with the core wire S and causing the anterior end of the core wire S to spread out. Consequently, no matter how often the attachment and removal operations of the battery terminal are carried out, there is no possibility of the core wire S, catching or damaging the operator's hands. Furthermore, by protecting the core wire from contact with the tools, damage to the core wire S is prevented.

Figure 4:
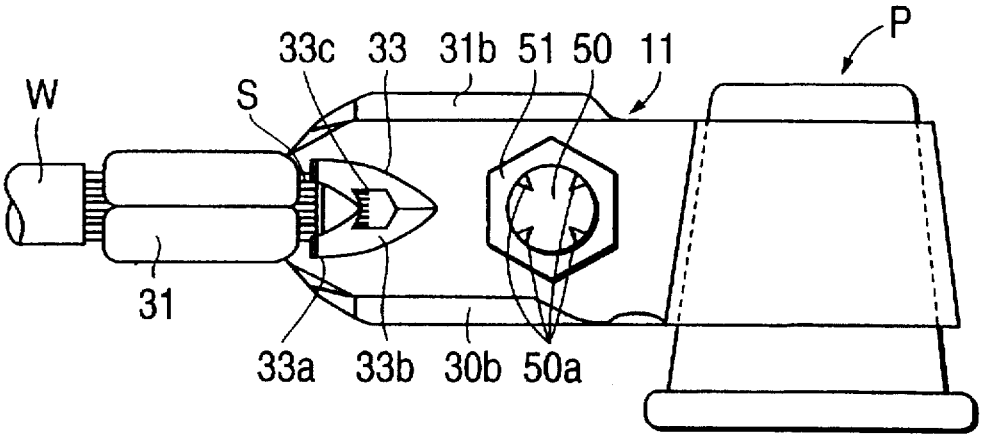
FIG. 4 is a side view of a battery terminal relating to the second embodiment of the present invention.
Figure 5:
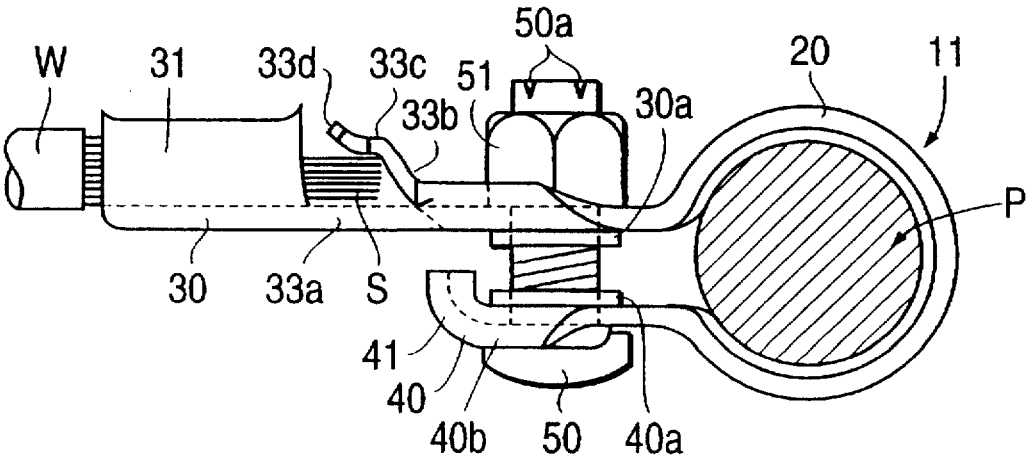
FIG. 5 is a plan view of the battery terminal of FIG. 4.

A second embodiment of the present invention is explained hereinbelow, with reference to FIGS. 4 and 5. As shown in FIG. 4, a battery terminal 11 has a core wire covering member 33 that is formed by shearing and pressing.

More specifically, the core wire covering member 33 has a somewhat triangular dome shape which has an opening 33a formed towards the right side of the wire barrel 31. A core wire S of an electric wire W is passed into this opening 33a. A wall 33b located on a side opposite to the opening 33a constitutes an abutment with which the wire can make contact.

An aperture 33c is punched in the covering member 33 so as to determine the extent of insertion of the core wire S. The mouth 33d of the covering member 33 is bent out slightly to present a flared or tapered entrance; this facilitates insertion of the core wire S.

Regarding the rest of the configuration, this is the same as in the first embodiment, and so the same numbers are accorded to parts similar to those in the first embodiment and overlapping explanations are omitted.

The dome shape protects the core wire S protruding from the wire barrel 31, thereby preventing the core wire S from being exposed towards the nut 51. As a result, the protection of the core wire S is more certain. Moreover, in the clamping process of the core wire S, if the core wire S is inserted from the opening 33a of the core wire covering member 33 so as to make contact with the inner wall 33b, the position of the core wire S with respect to the wire barrel 31 is more precise, and thus the stripping length of the insulated wire can also be precise, leaving the insulated covering close to the crimping barrel 31.

A third embodiment relating to the present invention is shown with reference to FIGS. 6 to 9.

Figure 6:
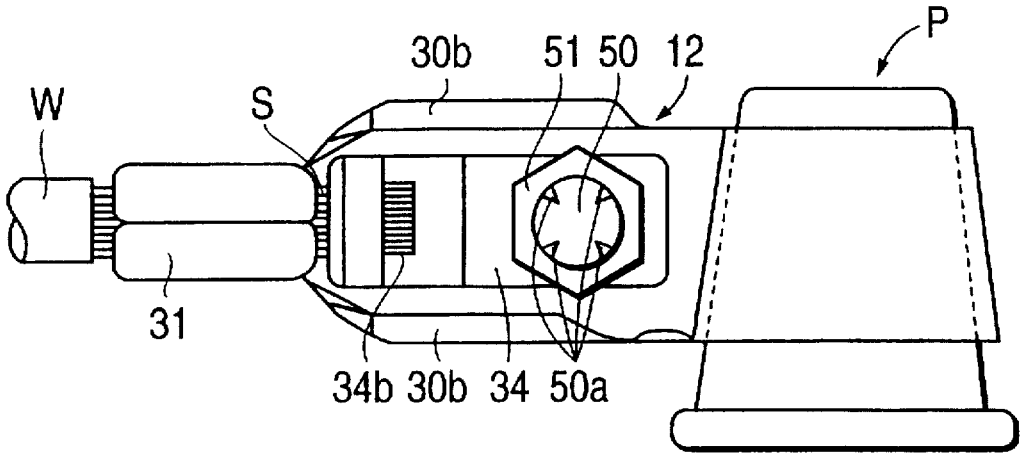
FIG. 6 is a side view of a battery terminal relating to the third embodiment of the present invention.
Figure 7:
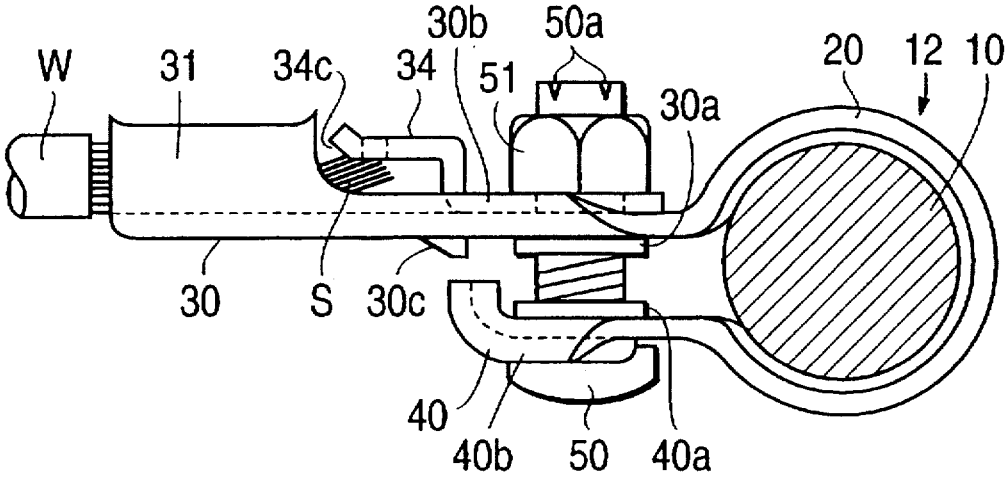
FIG. 7 is a plan view of the battery terminal of FIG. 6.

In FIG. 6, the right side of a wire barrel 31 of a battery terminal 12 has a core wire covering member 34 attached by means of a nut 51 and formed independently of the battery terminal 12.

Figure 8:
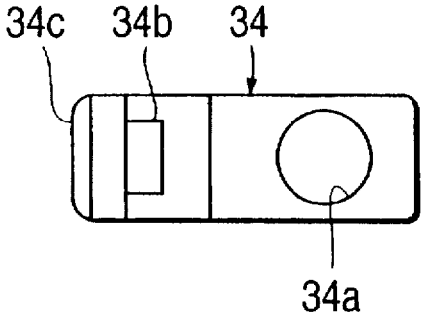
FIG. 8 is a plan view of the core wire covering member of the battery terminal.
Figure 9:
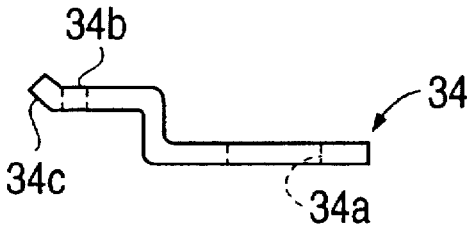
FIG. 9 is a side view of the core wire covering member of FIG. 8.
Figure 10:
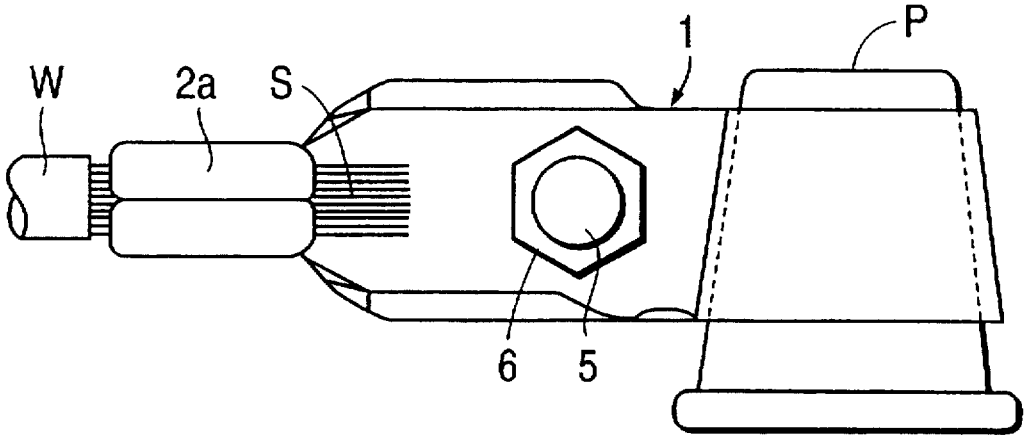
FIG. 10 PRIOR ART
FIG. 10 is a side view of a conventional battery terminal.
Figure 11:
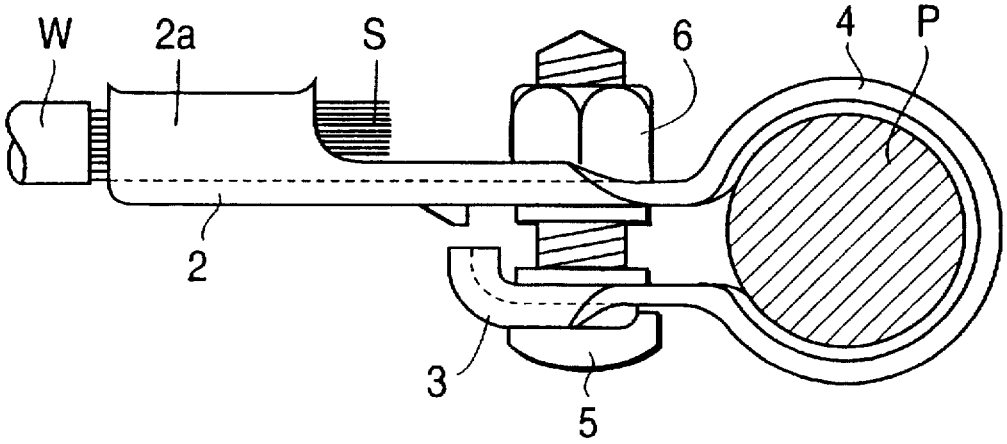
FIG. 11 PRIOR ART
FIG. 11 is a plan view of a conventional battery terminal.

More specifically, as shown in FIGS. 8 and 9, the core wire covering member 34 is formed by bending a metal piece in a crank shape and forming a through hole 34a at one end so as to allow a bolt 50 to pass through. In the attached state the core wire covering member 34 covers the anterior end of the core wire S which protrudes from the wire barrel 31. Further, the width of this covering member 34 fits exactly against side walls 30b of a fastening member 30. This prevents the covering member 34 from pivoting when the nut 51 is turned. An inspection aperture 34b and a tapered mouth 34c are provided as in the second embodiment.

Regarding the rest of its configuration, this is the same as in the first embodiment, and so the same numbers are accorded to parts similar to those in the first embodiment and overlapping explanations are omitted.

In the core wire covering member 34, the position of the core wire S is determined by abutment as in the case of the second embodiment. Moreover the member 34 can be attached subsequently and is a very simple shape. This lowers the production cost.

Since the covering member 34 is a separate piece, it can be formed so as to correspond in size to a conventional battery terminal, and thus it becomes possible to protect the core wire S even when using a conventional battery terminal.

The present invention is not limited to the embodiments described above with the aid of figures. For example, the possibilities described below also lie within the technical range of the present invention. Moreover, the present invention may be embodied in various ways other than those described below without deviating from the scope thereof.

(1) The core wire covering member 32 of the first embodiment covers only the upper side of the core wire S. However, it may be equally arranged so that, for example, an inner wall is provided on the nut side of the covering member 32, thereby providing an abutment member with which the core wire makes contact. If this is done, the position of the electric wire W can be fixed when the above-mentioned contact is made. Furthermore, if the configuration of the present embodiment is adopted, since the portion to be bent is small, production can be carried out at a low cost.

(2) Moreover, although it is arranged so that the core wire covering member 32 of the first embodiment has a pair of protecting members 32*a* extending from both sides, the protecting members 32*a* being made to meet near the centre by being bent inwards, it may equally be arranged so that, for example, a protecting member is made to extend from one side in a 'U' shape, the protecting member being bent so as to cover the core wire S from above.

(3) The punched out core wire covering member 32 of the second embodiment is arranged to cover the entire anterior end of the core wire S by being formed into a hood. However, it may equally be arranged so that, for example, both the member 32 is punched out in an arch shape and only the upper side of the core wire S is covered. If this configuration is adopted, the punching process is simplified.

(4) The first embodiment could be provided with an inspection aperture and a tapered or flared mouth. This is useful where the opposed arms are bent down prior to insertion of the core wire S.

We claim:

1. A terminal for attachment to a battery post comprising a connecting member for encircling said post, a wire barrel portion adapted to receive and crimp a bared core of an electrical wire for electrical connection of the barrel portion to the core wire, a threaded fastener to tighten the connecting member about said post by reducing the internal diameter thereof, and a covering member for the end of the core wire, the covering member being disposed between the connecting member and the wire barrel portion, said covering member having a first limb to cover the end of said core wire, and a second limb engaged by said fastener for retention thereof.

2. A terminal according to claim 1 wherein the terminal further includes an abutment to limit insertion of said core wire through said wire barrel portion.

3. A terminal according to claim 2 wherein said abutment is constituted by said covering member.

4. A terminal according to claim 1 wherein said connecting member and said barrel portion are formed of a bent metal strip.

5. A terminal according to claim 1 wherein said covering member defines a hood to substantially enclosed the end of said core wire.

6. A terminal according to claim 5 wherein the covering member includes an aperture therethrough for determining the extent of insertion of said core wire under the covering member.

7. A terminal according to claim 5 wherein said covering member includes a tapered mouth for facilitating insertion of said core wire under the covering member.

8. A terminal according to claim 1 wherein the covering member comprises an 'S' shaped sheet metal pressing, one end of which has an aperture to receive said threaded fastener and the other end of which covers said core wire.

9. A terminal according to claim 1 wherein the covering member includes an aperture therethrough for determining the extent of insertion of said core wire under the covering member.

10. A terminal according to claim 1 wherein said covering member includes a tapered mouth for facilitating insertion of said core wire under the covering member.

* * * * *